United States Patent [19]

Rehberg et al.

[11] Patent Number: 4,940,407

[45] Date of Patent: Jul. 10, 1990

[54] GAS-FIRED FIREPLACE LOG SET

[75] Inventors: Thomas R. Rehberg, Orange; Sam Brailoff, Whittier, both of Calif.

[73] Assignee: Mobex Corporation, Fullerton, Calif.

[21] Appl. No.: 346,779

[22] Filed: Nov. 6, 1989

Related U.S. Application Data

[63] Continuation-in-part of Ser. No. 144,411, Jan. 15, 1988, abandoned.

[51] Int. Cl.[5] ..... F23Q 2/32

[52] U.S. Cl. ..... 431/126; 126/92 R; 126/512

[58] Field of Search ..... 431/125, 126; 126/512, 126/92 R, 92 AC; 40/428

[56] References Cited

U.S. PATENT DOCUMENTS

| | | | |
|---|---|---|---|
| 852,679 | 5/1907 | Richards . | |
| 3,291,116 | 12/1966 | Brooks | 126/92 |
| 3,382,861 | 5/1968 | Peterson | 126/92 |
| 3,543,741 | 12/1970 | Whithead | 126/92 |
| 3,583,845 | 6/1971 | Pulone | 431/125 |
| 3,696,801 | 10/1972 | Whitehead | 126/92 R |
| 3,760,790 | 9/1973 | Voges et al. | 126/92 R |
| 4,042,313 | 8/1977 | Pierce | 431/126 X |
| 4,726,351 | 2/1988 | Whittaker et al. | 126/512 |

FOREIGN PATENT DOCUMENTS 0096111 12/1983 European Pat. Off. .

*Primary Examiner*—Carl D. Price

*Attorney, Agent, or Firm*—Christie, Parker & Hale

[57] ABSTRACT

A gas log set for a fireplace has sets of gas jets arrayed to provide a pleasing distribution of flames around and between several cast-concrete simulated logs. A glowing-ember effect is created beneath a front log and between the logs by strips of rock wool which radiate when heated. Both the simulated logs and the rock wool are doped with metallic salts which convert the complete-combustion blue coloration of a gas flame to a yellow-orange color which closely simulates the appearance of a natural wood fire.

1 Claim, 6 Drawing Sheets

GAS-FIRED FIREPLACE LOG SET

CROSS-REFERENCE TO RELATED APPLICATION

This is a continuation in part of U.S. patent application Ser. No. 07/144,411 filed Jan. 15, 1988, now abandoned.

BACKGROUND OF THE INVENTION

Gas logs for fireplaces are well known, and typically comprise one or more artificial logs made of a cast noncombustible material which simulates a natural wood log in appearance, and a gas burner positioned beneath the logs and equipped with conventional jets, gas lines and controls. Gas logs are advantageous in providing immediate high-level room heating with convenient and simple ignition, and without the bother of storage and handling of wood logs. Gas logs are usually supplied with either natural gas or propane, and these fuels are readily available and inexpensive.

Ideally, a gas log would closely simulate the pleasing aesthetic appearance of a wood-burning fireplace. Conventional gas logs fail to achieve this objective, both from the standpoint of flame color, and because of the shape and distribution of the gas flame. When properly adjusted for safe and complete combustion, a gas flame is blue in color, and lacks the desired yellow-orange flame coloration of burning natural wood. Adjustment of gas-air mixture to produce a yellowish flame can result in unsafe and potentially toxic incomplete combustion which is contrary to standards of the American National Standards Institute and a violation of clean-burning statutory requirements of a growing number of states.

This invention is directed to an improved gas-fired log set which provides safe and complete gas combustion, and is very close in flame color and appearance to a natural wood fire.

SUMMARY OF THE INVENTION

The log set of this invention has a base which supports a heat-insulating refractory plate, and on which are mounted a gas valve, pilot assembly, and gas lines. A burner assembly rests on the refractory plate, and supports a pair of connected and integrally cast-concrete simulated logs and a pair of non-connected logs. The burner assembly also supports bodies of rock wool or similar material beneath and between the logs to simulate the glowing embers and under-fire effect of a fireplace burning natural wood.

The burner assembly has a gas plenum which defines a spaced arrays of gas jets to create flames around and between the logs, and to impinge on the rock-wool bodies and associated support troughs. The heated rock wool radiates a glowing-ember appearance which enhances the simulation of a natural wood fire, and the logs and/or the rock wool or similar material are doped with metallic salts to alter the blue color of a complete-combustion gas flame to the pleasing yellow-orange color of a wood fire.

DESCRIPTION OF THE PREFERRED EMBODIMENT

Figure 2:
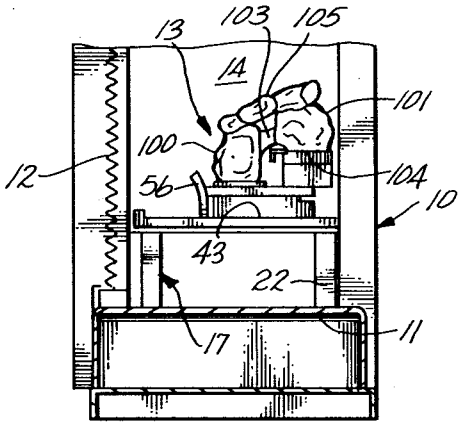
FIG. 2 is a side view, partly in section, and on line 2—2 of FIG. 1.
Figure 1:
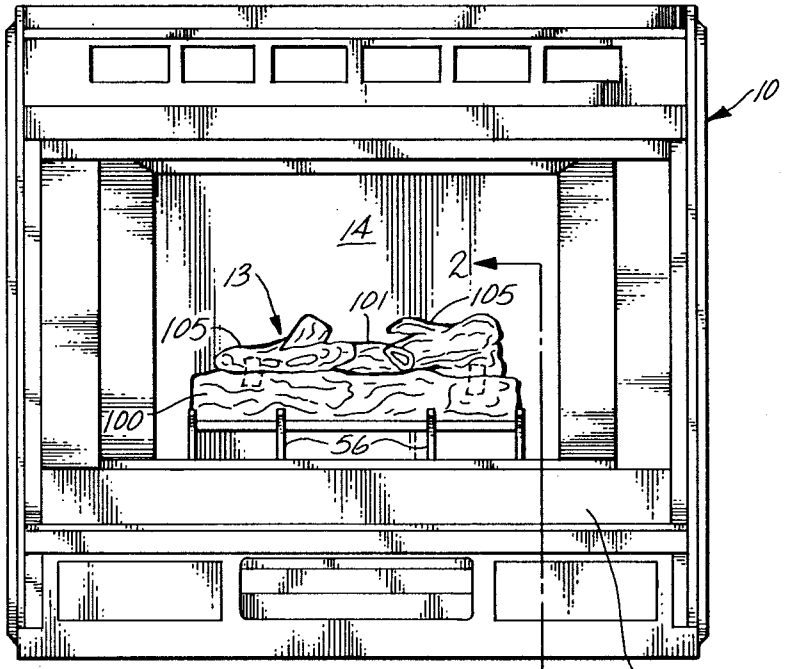
FIG. 1 is a front elevation of a factory-built fireplace assembly using a gas-log assembly according to the invention.
Figure 3:
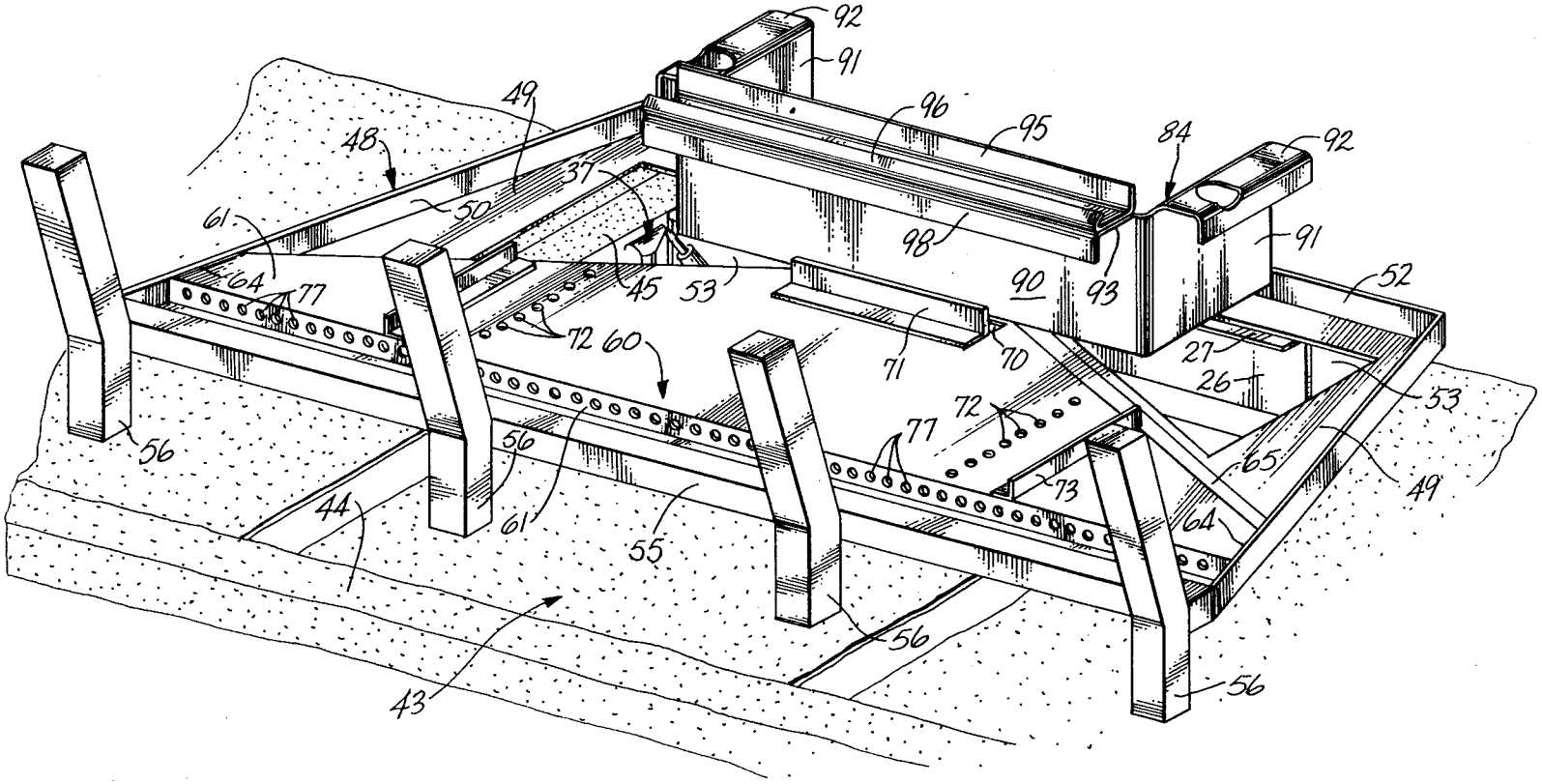
FIG. 3 is a pictorial view of a burner assembly.

FIGS. 1 and 2 show a factory-built fireplace assembly 10 of sheet-metal construction, and of the heat-circulating zero-clearance type for installation at the framing stage of home or apartment construction. Assembly 10 is of a conventional style with a base 11 housing an optional air-circulating fan (not shown), a sliding fire screen 12, and the usual vents and fittings common to factory-built fireplaces. A gas-fired log assembly 13 is supported on base 11, and is centrally positioned within a firebox space 14 of the fireplace.

Figure 4:
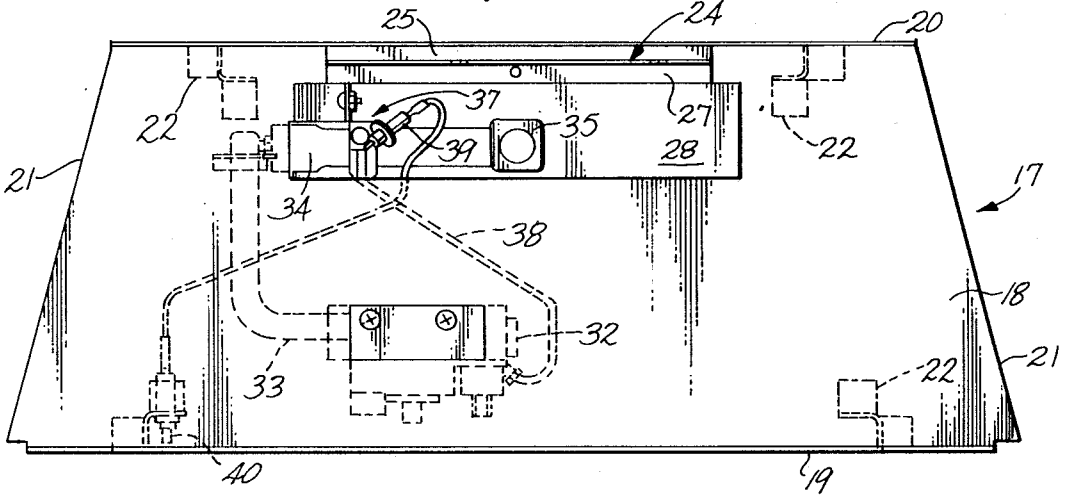
FIG. 4 is a top plan view of a base for the burner assembly.
Figure 5:
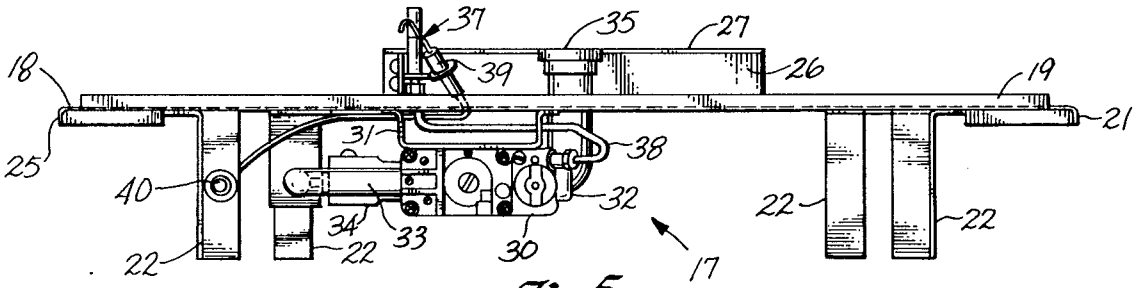
FIG. 5 is a front elevation of the base shown in FIG. 4.

Log assembly 13 includes a base 17 shown in greater detail in FIGS. 4 and 5, and having a sheet-metal top plate 18 which in plan view is shaped as an isosceles trapezoid. The top plate has upwardly turned front and rear edges or lips 19 and 20, and downwardly turned side edges or lips 21. Four downwardly extending angle-iron legs 22 are welded to the undersurface of top plate 18 adjacent its four corners.

An elongated burner support 24 is positioned adjacent the rear edge of top plate 18, and has a base flange 25 welded to the top plate, an upwardly extending leg 26, and a horizontal top flange 27 extending from the leg. An elongated and generally rectangular opening 28 is cut through the top plate just forward of support 24.

A conventional gas valve 30 (the type made by Robertshaw Grayson is satisfactory) is supported on a bracket 31 welded to the underside of the top plate, and the valve has an inlet fitting 32 for connection to a gas supply line (not shown). The valve has an outlet line 33 with a conventional air-inlet venturi 34 leading to an upwardly turned flanged connection 35 which is centrally positioned within rectangular opening 28.

A pilot-light assembly 37 is secured to the upper surface of the top plate adjacent one side of opening 28, and is connected to valve 30 by a small gas tube 38. A piezoelectric igniter 39 is positioned adjacent the pilot-light assembly, and is operated by a push button 40 mounted on one of front support legs 22 for access from the front of the fireplace assembly. The gas valving, controls and pilot are conventional, and, for brevity, will not be described in greater detail.

Figure 6:
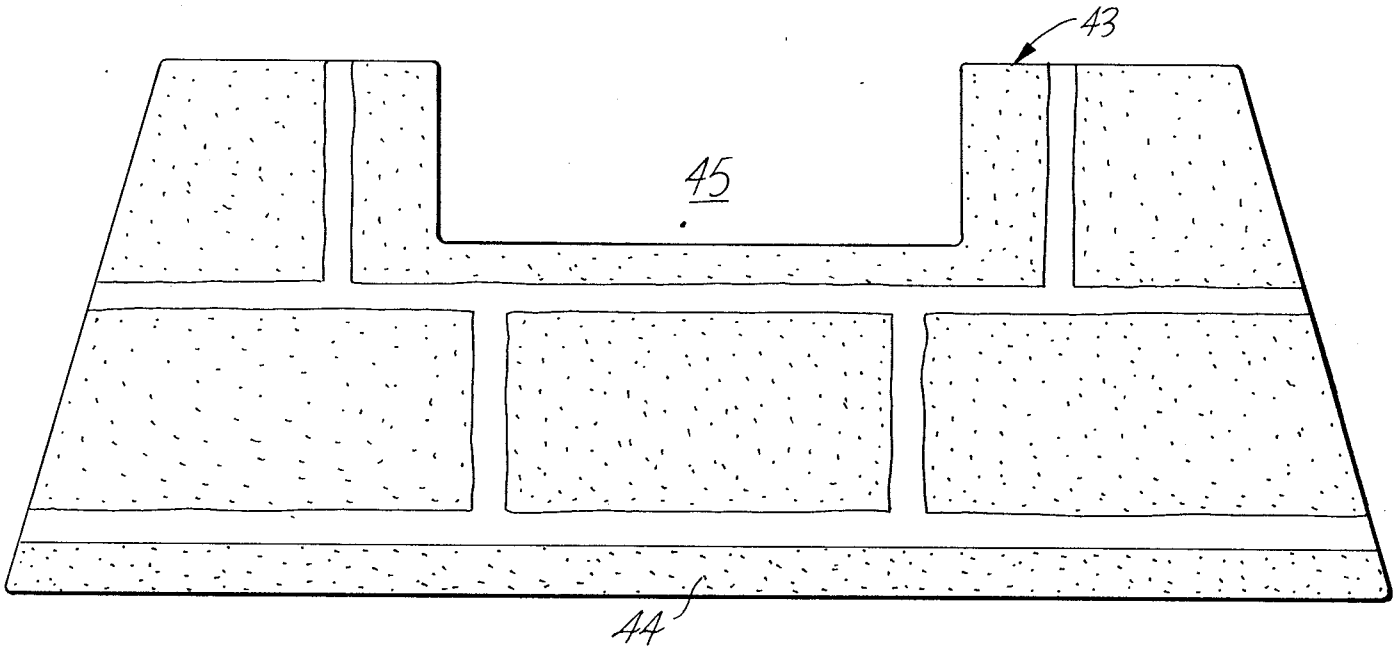
FIG. 6 is a top plan view of a heat-insulating spacer plate.

A textured, decorative and heat-insulating spacer plate 43 (FIGS. 2 and 6) made of cast refractory cement is shaped in plan view to correspond to the shape of top plate 18, and rests on the top plate between upwardly turned edges 19 and 20. The spacer plate has a raised front edge 44, and a rectangular opening 45 therethrough which extends forwardly from the spacer-plate rear edge. Opening 45 is generally aligned with opening 28 in top plate 18 to provide an open window from the undersurface of the top plate to the upper surface of the spacer plate.

Assembly 13 further includes a burner assembly 48 (FIGS. 3 and 7–12) with a sheet-metal base panel 49 having upwardly turned side edges 50 and front and rear edges 51 and 52. The base panel is again generally shaped in plan view as an isosceles trapezoid, but is somewhat smaller than base 17 and arranged to be generally centrally positioned on spacer plate 43. A pair of spaced-apart openings 53 extend through the rearward part of the base panel to provide clearance for pilot-light assembly 37, and to enable circulation of air through the heated zone of the fireplace.

A horizontal bar 55 is welded to and extends along front edge 51 of base panel 49, and four spaced-apart and slightly forwardly angled upright bars 56 (FIGS. 3 and 7–8) are welded to bar 55. Bars 56 support the front of the burner assembly on spacer plate 43, and provide an andiron-like front support for artificial logs as described below. A hat-section stiffening channel 57 (FIG. 9) is welded to the undersurfaces of bar 55 and base panel 49, and extends along the length of the forward end of the base panel.

A gas plenum 60 is formed on the top of base panel 49 by a sheet-metal panel 61 with a continuous and downwardly turned sidewall 62 around its perimeter. The lower front surface of sidewall 62 has an outwardly and forwardly extending horizontal flange 63 (FIG. 9) welded to the upper surface of the base panel above stiffening channel 57. Short and slightly inwardly angled opposed ends 64 of sidewall 62 fit snugly within and are welded to side edges 50 of the base panel. The rear part of sidewall 62 is sharply angled inwardly to form a shallow V-shape (FIGS. 3 and 7), and has at its lower end a rearwardly extending horizontal flange 65 welded to the top of the base panel adjacent openings 53.

Gas is fed to the plenum through an opening 67 in base panel 49 which is aligned with gas line 33. The gas line is coupled to the base panel by flanged connection 35 (FIG. 8), and suitable conventional gasketing is provided at this junction. The plenum thus provides a housing for directing the inwardly flowing fuel gas to a series of carefully positioned outlet ports or jets as described below.

Figures 7, 8, 9, 10, 11, 12:
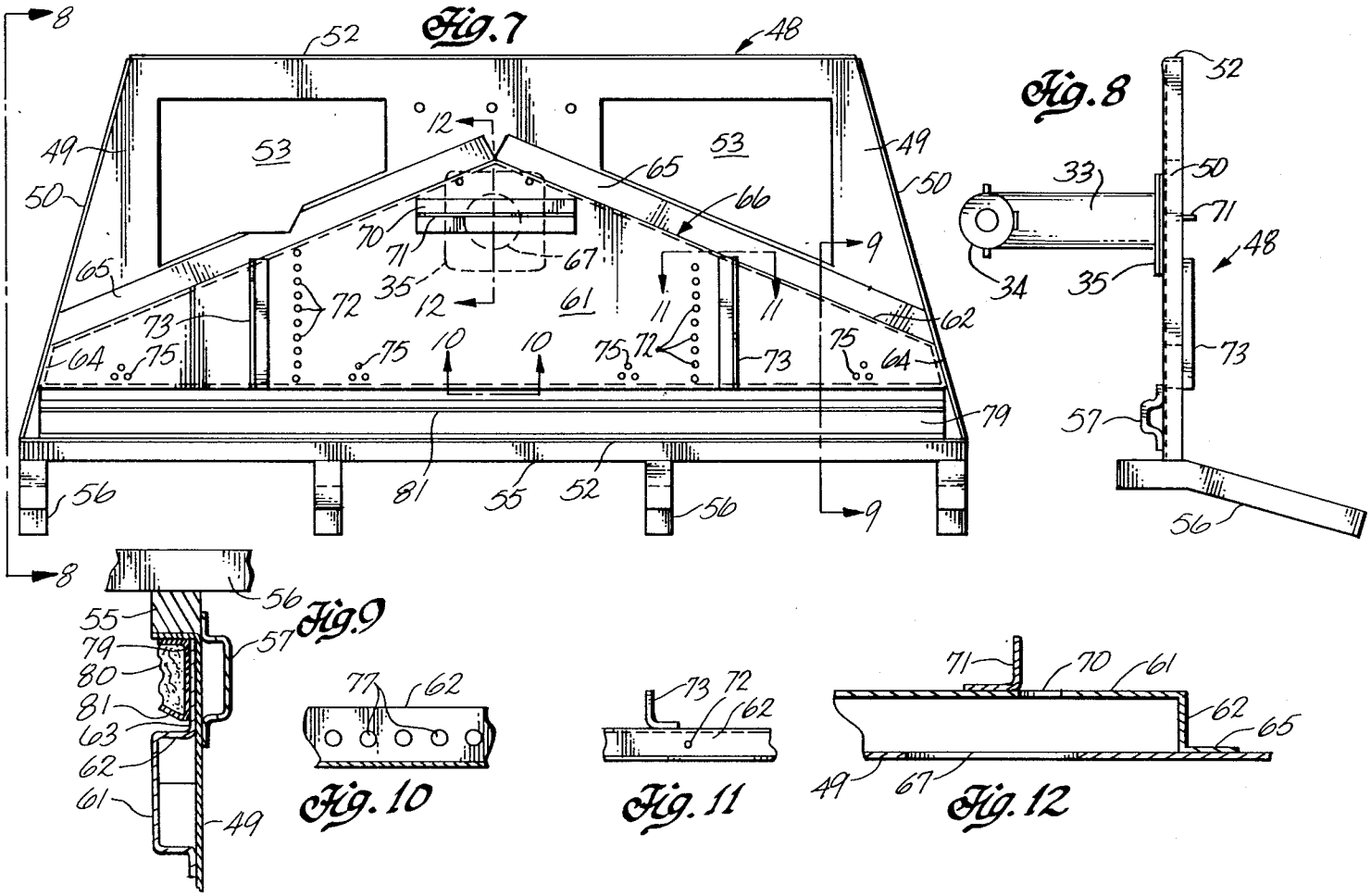
FIG. 7 is a top plan view of the burner assembly shown in FIG. 3.
FIG. 8 is an end view on line 8—8 of FIG. 7.
FIG. 9 is a sectional view on line 9—9 of FIG. 7.
FIG. 10 is a view on line 10—10 of FIG. 7.
FIG. 11 is a view on line 11—11 of FIG. 7.
FIG. 12 is a sectional view on line 12—12 of FIG. 7.
Figure 13:
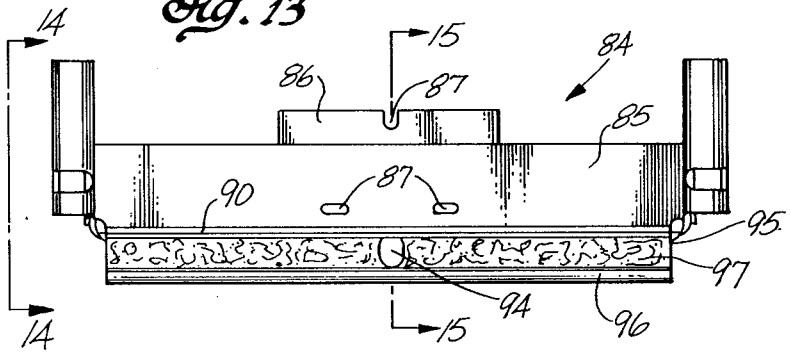
FIG. 13 is a top plan view of a log-supporting flame spreader for the burner assembly.
Figure 14:
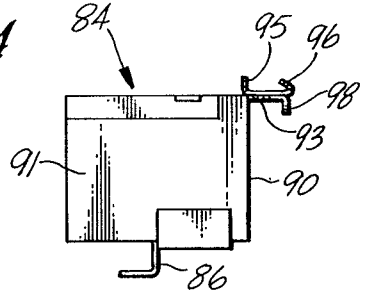
FIG. 14 is an end view on line 14—14 of FIG. 13.
Figure 15:
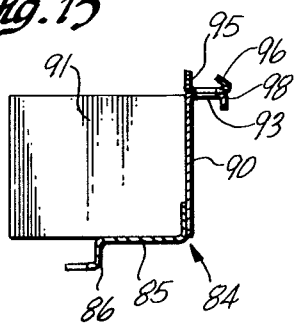
FIG. 15 is a sectional view on line 15—15 of FIG. 13.

A main burner jet 70 is cut through the panel 61 as a longitudinally extending rectangular opening (typically about ¼ inch by 3 inches) positioned adjacent the rear of the plenum. A right-angled spacer leg 71 is welded to the top of the plenum and extends along the front edge of jet 70 to prevent the artificial logs (described below) from obstructing the main jet. Spaced apart on opposite sides of main jet 70 are two linear arrays of circular openings (a diameter of about 0.098 is typical) drilled through panel 61 and extending from the front to the rear of the plenum (including a rear terminal opening in rear flanges 65 as shown in FIG. 11) to form fore-and-aft lateral jets 72. Right angled spacer legs 73 are welded to the top of panel 61 adjacent these linear lateral-jet arrays to support the artificial logs and prevent jet obstruction.

Four spaced-apart triangular arrays of front longitudinally extending circular jets 75 are formed through the plenum in the same fashion as jets 72, and provide a pleasing distributed flame structure at the front of the artificial logs. The burner-assembly jet structure is completed by a linear array of openings which extend along the entire length of the front of plenum sidewall 62 just above flange 63 to form underlog jets 77 (FIG. 10). In a typical configuration, there are about ninety jets 77 which are evenly spaced apart on 3/16 inch centers, and with diameters of about 0.098 inch.

An elongated trough member 79 (FIGS. 7 and 9) is welded to front flange 63 above stiffener 57 in the channel-like space between the front surface of panel sidewall 62 and the inner surface of upturned front edge 51 of the base panel. The trough member runs the full length of this channel to abut panel side edges 50 at its opposite ends (FIG. 7). The trough member is packed full with a strip of rock wool or ceramic-type material 80 which is retained and trapped by forward angulation of a rear wall 81 of the member as best seen in FIG. 9.

Burner assembly 48 is completed by a flame spreader assembly 84 (FIGS. 3 and 13–15) with a base 85 which rests on the rear top surface of panel 61 behind and immediately adjacent main jet 70. A support leg 86 extends downwardly and rearwardly from the back of base 85 to rest on the upper rear surface of base panel 49, and holes 87 in the base and support-leg horizontal flange accommodate sheet-metal screws to secure the flame-spreader assembly to the top of the burner assembly.

The flame-spreader assembly has a vertical front wall 90 extending upwardly from the front edge of base 85, and log-supporting sidewalls 91 with outwardly extending top flanges 92 extend rearwardly from opposite ends of the front wall over base 85. A horizontal flange 93 with a central circular opening 94 extends forwardly from the top of front wall 90 to support a second channel-like elongated trough member 95. A front wall 96 of the trough member is rearwardly angled to retain a pair of strips of rock wool 97 which fill the trough member on opposite sides of opening 94.

The forward edge of horizontal flange 93 defines a downwardly extending lip 98, and the horizontal flange is positioned directly over main burner jet 70 to spread and diffuse the flame emerging from the jet when the gas is ignited. The various components of the flame-spreader assembly are of simple sheet-metal construction, and the components are most easily secured together by spot welding.

Simulated logs 100 and 101 (FIGS. 1–2) are preferably made of cast concrete with rough exterior surfaces which simulate the surface of a natural wood log. Preferably, the ends of the logs are joined by narrow integrally cast links 103 which maintain a fixed spacing and positioning of the logs. A clearance space between the logs and links 103 accommodates front wall 90 and flange 93 of the flame-spreader assembly. The logs are cast with flat bases 104 which rest behind angled bars 56 on spacer legs 73 and top flanges 92 respectively of the burner assembly.

Preferably, a pair of small, cast-concrete simulated logs 105 rest across and on the tops of logs 100 and 101 to provide an appearance very similar to natural wood logs in a fireplace. The logs are preferably impregnated with a metallic salt (sodium chloride, for example) which alters the normal blue color of a gas flame to a pleasing wood-fire-like yellow-orange color. Similarly, rock wool strips 80 and 97 are also doped with a metallic salt (sodium silicate is preferred as it adheres the rock wool in the supporting trough) for the same purpose of flame-color alternation to a yellow-orange appearance. Other dopants can be used, and common baking soda also provides satisfactory flame coloration.

As an alternative to rock-wool strips 97 in trough member 95, good flame coloration is provided by positioning a soda-lime glass rod (not shown) in the flame as a source of ion donation. To avoid temperature-induced sagging, the glass rod is preferably supported by a stainless steel bar. Alternatively, the glass rod can be formed as a hollow tube which is fitted over a supporting stainless steel rod.

In operation, gas valve 30 is opened to pressurize plenum 60 with flammable fuel which issues from the several jet systems to be ignited by pilot light assembly 37. The initial blue gas-flame color quickly changes to yellow-orange as the logs and rock-wool bodies heat to the point where the metallic-salt dopants donate sodium ions to the flames.

Main jet 70 and lateral jets 72 provide the main flame body about and between the logs, and jets 75 provide additional spaced flames at the lower front surface of front log 100. The flames from jets 77 impinge directly on trough member 79 to heat rock wool 80 to incandescence, and this glowing radiation closely simulates the ember bed of a natural wood fire. A similar flowing-ember effect appears between the main logs by radiation from heated rock-wool strips 97 which are heated from below by the main burner jet, and by flame penetrating through opening 94 of the flame-spreader assembly.

The fuel-air ratio is adjusted to provide safe and complete combustion of the gas, but the desired yellow-orange flame color is achieved by the metallic-salt dopants. The distribution of flame beneath, across and between the logs, coupled with the glowing-ember appearance of the doped rock-wool bodies, provides a gas-burning fireplace assembly which closely simulates a natural wood fire, while retaining the convenience and economy of a gas log set.

What is claimed is:

1. A gas log assembly for a fireplace, comprising:

a base;

a burner assembly supported on the base and defining a gas plenum, the plenum having a generally centrally positioned main jet, a pair of lateral jet arrays on opposite sides of the main jet to extend fore-and-aft when the gas log assembly is positioned in the fireplace, and a linear array of underlog jets extending across the front of the plenum;

the burner assembly further including a flame-spreader assembly extending above the main jet, a first flame-coloration means on the flame-spreader assembly, and a second flame-coloration means supported adjacent and extending along the underlog jets;

an artificial log supported on the flame-spreader assembly; and means for supplying gas to the plenum;

the flame-coloration means being effective to change flame coloration of ignited gas issuing from the jets from blue to yellow-orange.

* * * * *